United States Patent [19]

Belviso et al.

[11] Patent Number: 4,541,519

[45] Date of Patent: Sep. 17, 1985

[54] COIN-OPERATED, ELAPSED TIME APPARATUS

[75] Inventors: Vincent Belviso, Babylon; William H. Wicks, Huntington, both of N.Y.

[73] Assignee: Cyclonic Equipment Co., Inc., Deer Park, N.Y.

[21] Appl. No.: 568,427

[22] Filed: Jan. 5, 1984

[51] Int. Cl.[4] ..... G07F 5/16

[52] U.S. Cl. ..... 194/1 N; 194/9 T

[58] Field of Search ..... 194/1 G, 9 T, 1 N, 1 L; 377/7, 52

[56] References Cited

U.S. PATENT DOCUMENTS

| | | | |
|---|---|---|---|
| 2,735,005 | 2/1956 | Steele | 250/17 |
| 3,279,480 | 10/1966 | Jarvis | 133/8 |
| 4,124,110 | 11/1978 | Hovorka | 194/100 A |
| 4,173,272 | 11/1979 | Knorring | 194/9 T |
| 4,176,739 | 12/1979 | Corcoran, Jr. | 194/9 T |
| 4,192,972 | 3/1980 | Bertoglio et al. | 194/1 N |

*Primary Examiner*—Stanley H. Tollberg

*Attorney, Agent, or Firm*—Stanley Ira Laughlin

[57] ABSTRACT

A coin operated elapsed time apparatus capable of receiving coins at any time, even while counting down, in order to increase the time remaining and therefore avoid the additional costs required to activate the system again if the service or use of apparatus required that more time be rented or purchased. The apparatus continuously displays the time remaining and gives a warning a predetermined period of time before the time runs out, thereby enabling the purchase of additional time and displaying the sum of the elapsed time remaining and the additional time purchased immediately after the insertion of an additional coin.

2 Claims, 6 Drawing Figures

COIN-OPERATED, ELAPSED TIME APPARATUS

BACKGROUND OF THE INVENTION

The invention relates to timing apparatus, and in particular to timing devices for coin-operated, elapsed time apparatus such as classified in class 194, subclasses 9,16 and 18.

Counting circuits for adding and subtracting digital pulses, such as described in U.S. Pat. No. 2,735,005 to Steele, are well known.

Coin receiving circuits, such as described in U.S. Pat. No. 3,279,480 to Jarvis and U.S. Pat. No. 4,124,110 to Hovorka are likewise well known.

Elapsed time timing devices are well known, and the use of such timers for counting down a purchased period of time, such as taught in U.S. Pat. No. 4,176,739 to Corcoran, are well known.

SUMMARY OF THE INVENTION

The invention comprises electronic logic circuitry which is combined in a manner to function with mechanical coin receiving apparatus so as to provide the consumer of the rented or purchased service or use of apparatus means for increasing and displaying the additional time being rented in predetermined increments at lower costs while said paid for service or apparatus use is being utilized without waiting for the timer to run out before depositing additional coins.

It is an object of applicant's invention to provide the consumer of rented or purchased services or apparatus use with the means of increasing the period of time and having the additional elapsed time being rented displayed while utilizing said service or apparatus.

It is a further object of applicant's invention to provide the consumer of rented or purchased services or apparatus use with more economical and efficient services or use of apparatus.

It is yet a further object of applicant's invention to provide the consumer of rented or purchased service or apparatus use with simple means for monitoring said services or use.

DETAILED DESCRIPTION OF THE INVENTION

Figure 1:
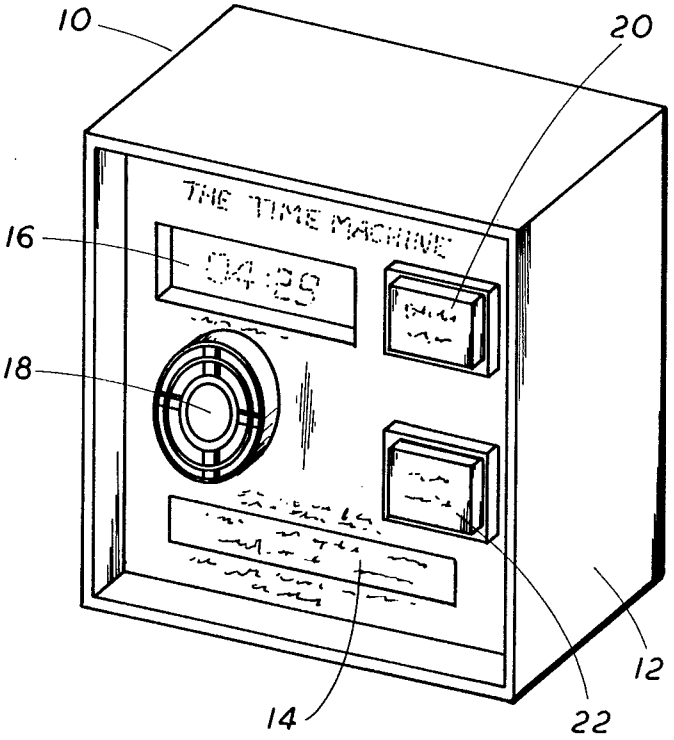
FIG. 1 is an isometric projection of the apparatus comprising applicant's invention.

FIG. 1 shows applicant's inventive apparatus 10 comprising frame 12, panel cover 14, LCD display readout 16, alarm 18, system on light 20, and last minute light 22.

The operation of the apparatus 10, which is compatible with most mechanical coin acceptors (not shown) is initiated by inserting the required coins into the coin acceptor, the alarm 18 will momentarily beep and the LCD readout 16 will display the amount of time paid for in minutes and seconds, the service or apparatus being paid for will function, the system on light 20 will be lit and the timer will count down displaying the time as it elapses. When only one minute of service or use time remains, the LCD readout 16 will indicate 59 seconds and counting down, the last minute light 22 will flash, and the alarm 18 will sound. The consumer of the rented service or apparatus use will have the option of allowing his time to run out or purchase additional time at a cost less than it would cost to start the service or use of apparatus over again if the time was allowed to run out. This option is easily exercised by inserting the coin or coins for the additional time to be purchased. The additional time paid for plus the time remaining will appear in the LCD readout 16, and the service or apparatus use will continue until the time displayed has run out. The last minute light 22 will go out and the alarm 18 will cease until the LCD readout 16 again indicates 59 seconds.

Figure 2A:
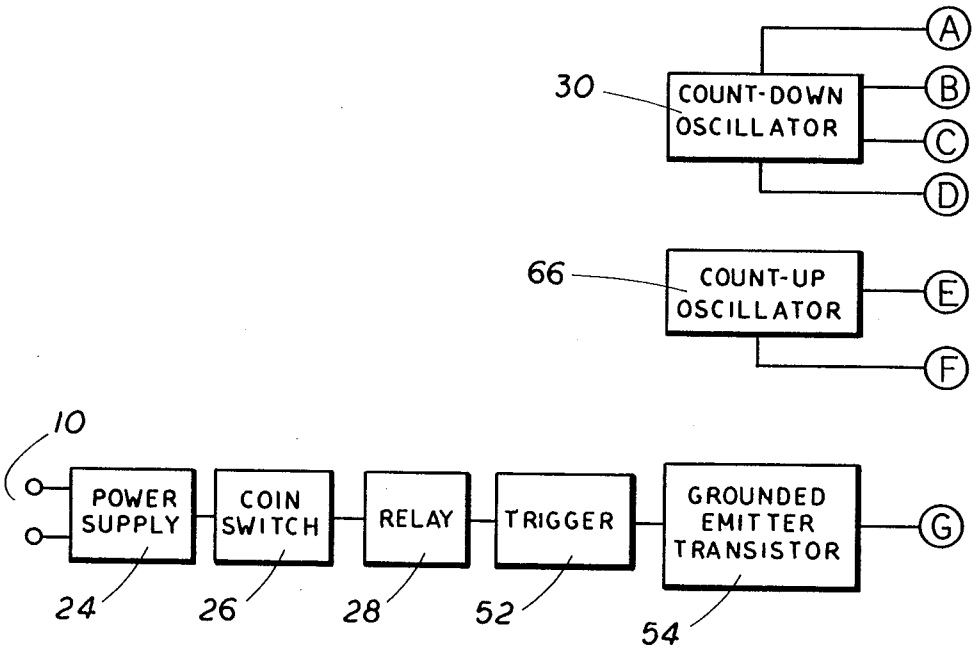
FIGS. 2*a* and 2*b* comprise the block diagram of the circuit components comprising applicant's invention.
Figure 2B:
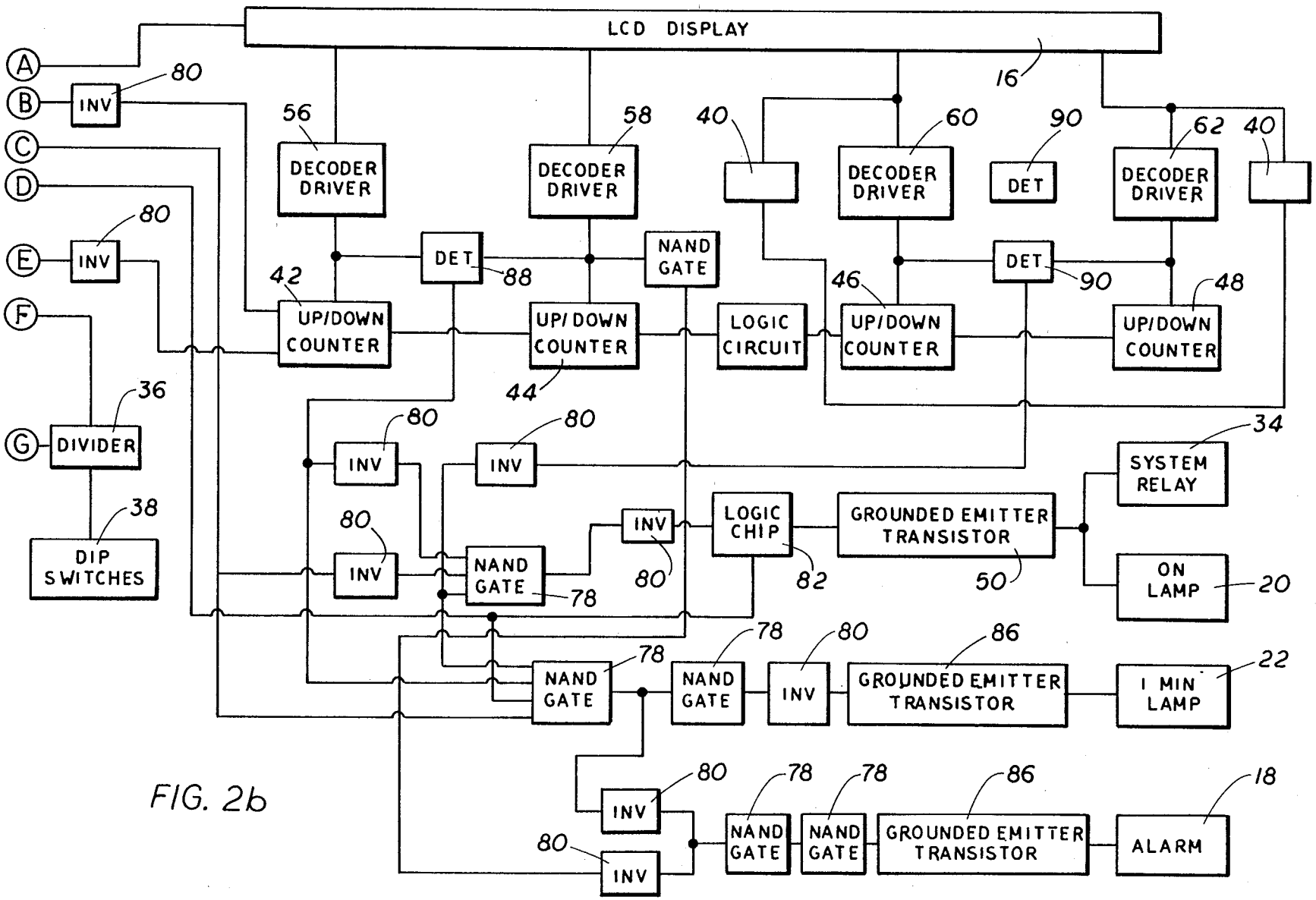

FIGS. 2*a* and 2*b* comprises the block diagram of the circuit components and their primary interconnections for the apparatus shown in FIG. 1. A primary 24 volt ac power line supplies a power supply 24, relay 28 associated with coin switch 26, count down oscillator 30, LCD display readout 16, and the system relay coil 34.

The power supply 24 provides the required voltage for the alarm and 5 volts dc to divider 36, count down oscillator 30, dip switches 38 for setting the time period per coin, dip switches 40 for setting the time period before system relay coil 34 is energized, BCD Up/-Down Counters 42,44,46, & 48, grounded emitter, switching transistors 50, trigger circuits 52, grounded emitter, transistor 54 and BCD to 7 Segment Decoder/-Drivers 56,58,60 & 62.

Relay 28 is energized by the closing of coin switch 26, and under this condition provides a ground to the one shot circuitry comprising trigger circuits 52, which results in grounded emitter transistor 54 resetting Divider 36 to zero. The output of Divider 36 actually goes to its high setting and enables the 1,000 pulses per second count up oscillator 66 to feed pulses as through a window into BCD Up/Down Counter 42 as well as Divider 36. Divider 36 allows a predetermined quantity of pulses at 1,000 pps selected by setting dip switches 38; at which time the output of Divider 36 goes to its low setting and inhibits any further delivery of the 1,000 pps from the count up oscillator 66. This low setting of Divider 36 will remain until reset by grounded emitter transistor 54 by the insertion of coins into coin switch 26. The time period per coin is the predetermined quantity described above as selected by the setting of dip switches 38. The primary reason for introducing pulses at a high rate is to enable the display to instantly show the up count pulses without showing a count up to the eye which would be the case if the additional pulses were introduced at low rates.

The BCD Up/Down Counters 42,44, count seconds and tens of seconds and the output of BCD Up/Down Counter 44 is decoded by NAND gate 78' to produce an output whenever it reaches a count of six. The cross-coupled NAND gates 78'' and 78''' produce a one shot momentary pulse to reset BCD Up/Down Counters 42 and 44 and a count up pulse to the up input of BCD Up/Down Counter 46. BCD Up/Down Counters 46 and 48 count minutes and tens of minutes. When the total count of BCD Up/Down Counters 42 and 44 reaches a count of sixty, a carry pulse is generated to BCD Up/Down Counter 46 and BCD Up/Down Counters 42 and 44 are reset to zero. The LCD Display 16 actually receive a sixty display, but it happens so fast that the eye can't detect it even though the display may be capable of instantaneously displaying it. The BCD UP/Down Counter 42 receives the count up pulses and the count down pulses for transmission to LCD display readout 16 via BCD to 7 Segment Decoder/Drivers 56,58,60 and 62. It is noted that the binary information at the outputs of BCD Up/Down Counter 42, 44, 46 and 48 is static unless the count is physically changing. There are no pulses visible at the outputs of zero seconds Detector 88 which produces a low output when all of the inputs from the BCD Up/Down Counters 42 & 44 are low, while detector 90 produces a low output when all of the inputs from BCD Up/Down Counters 46 & 48 are low. Dip switches 40 are set to predetermine the time period before the system relay coil 34 is energized. Logic circuit components employing NAND Gates 78, inverters 80, grounded emitter transistor 50 and System On Flip-Flop logic chip 82 are employed to control the bidirectional transfer of pulses between BCD Up/Down Counters 42, 44 and BCD Up/Down Counters 46, 48 as well as the energizing of the system relay coil 34, the system on light 20, last minute light 22 and alarm 18.

After the BCD Up/Down Counters have been loaded with a time and the system goes on, the down input of BCD Up/Down Counter 42 receives a pulse every second from the down count oscillator 30. When BCD Up/Down Counter 42 reaches a count of zero, the borrow output of BCD Up/Down Counter 42 generates a pulse into the down input of BCD Up/Down Counter 44. When BCD Up/Down Counter 44 reaches a count of zero its borrow output pulses the down input of BCD Up/Down Counter 46 through NAND gate 78''''' and 78 ''''' which generates a one shot narrow pulse to the load inputs of BCD Up/Down Counters 42 and 44 to effect a display of the unit nine seconds and tens of seconds of five for a total of 59 seconds.

Counting down continues in this fashion of borrowing and preset load conditions until all counters contain zero counts; causing each of the outputs of detectors 88 and 90 to go low. The low outputs of detectors 88 and 90 causes the output of NAND gates 80 to go high. The high outputs of NAND gates 80 are inputs to NAND gates 78 whose output at the next down count pulse from down count oscillator 30 is a low to inverter 80, which in turn resets System On Flip-Flop logic chip 82, and this in turn switches off the system relay coil 34 through grounded emitter transistor 50 which deenergizes the triac associated therewith. Detector 90 keeps the above operation from occurring as long as there is a positive count in either or both BCD Up/Down Counters 46 and 48.

As previously stated, zero seconds detector 88 is connected to output lines of BCD Up/Down Counters 42 and 44. NAND gate 78 is connected to the first and third output lines which are weighted in binary coding as 1 and 4. This connection, among other functions, determines the length of time the alarm sounds during the last minute of operation. This is easily seen because at this time detector 90 is low and the output of detector 88 is high since there are no minute counts in BCD Up/Down Counters 46 and 48 and there are second counts remaining in BCD Up/Down Counters 42 and 44, therefore NAND gate 78 will result in the alarm 18 sounding as long as the output of BCD Up/Down Counter 44 reads a count five or greater. This alarm will sound until the input to NAND gate 78 that is connected to the primary 1 line goes low thereby resulting in an alarm sounding for 9 seconds. Removing the primary 1 input to NAND gate 78 will increase the alarm time an additional ten seconds since the alarm will then sound until the primary 4 line goes low.

Detector 40 dip switches which are positioned between the outputs of BCD Up/Down Counters 46 and 48 and a source of voltage select the minimum quantity of minutes before the System On Flip-Flop logic chip 82 is reset, resulting in the energizing of the triac associated with grounded emitter 50, and the energizing of system relay coil 34. The output of System On Flip-Flop logic chip 82 inhibits the one pps down count from reaching the down input of the BCD Up/Down Counter 42 until the system relay coil 34 is energized. The output of the System On Flip-Flop logic chip 82 inhibits the NAND gate 80 associated with down count oscillator 30.

Figure 3A:
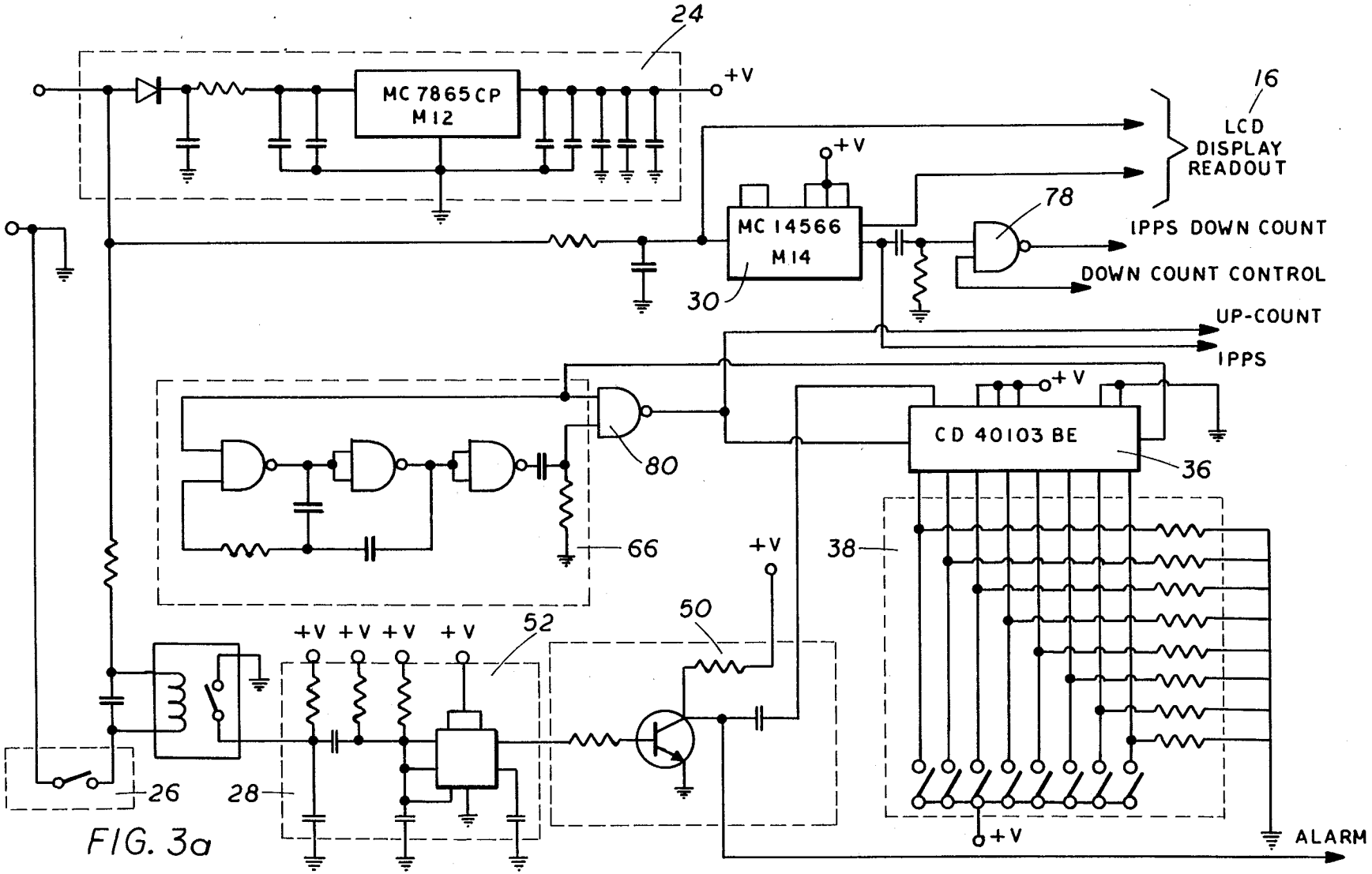
FIGS. 3(*a*), 3(*b*), and 3(*c*) comprise the schematic drawing of the detailed circuit components for applicant's invention shown in FIGS. 1,2*a* and 2*b*.

Referring to FIG. 3*a*, the operation of applicant's inventive apparatus is initiated by the insertion of coins in the coin receptor which closes coin switch 26 and thereby grounds relay coil 28 thereby energizing it, so as to close its relay contact and grounding the input circuitry to trigger circuit 52, whose function is to generate a step voltage approximately 250 milliseconds long that is transmitted to the alarm circuitry, resulting in a momentary beep, as well as to Divider 36 via grounded emitter switching transistor 50. Prior to the receipt of the step voltage by Divider 36, dip switches 38 were set so that the time period per coin would be determined and the step voltage in conjunction with these predetermined dip switch voltages would enable Divider 36 to act as a window to allow the passage of count up pulses, generated at 1,000 pulses per second in the count up oscillator 66, to produce quantities of pulses per coin to the BCD Up/Down Counter 42. A count down oscillator 30 which produces pulses at the rate of one pulse per second sends these pulses only to the BCD Up/Down Counter 42 when the system coil 34 is energized because at this time a non-inhibiting signal arrives at the inverter 80 associated with the count down oscillator 30.

Figure 3B:
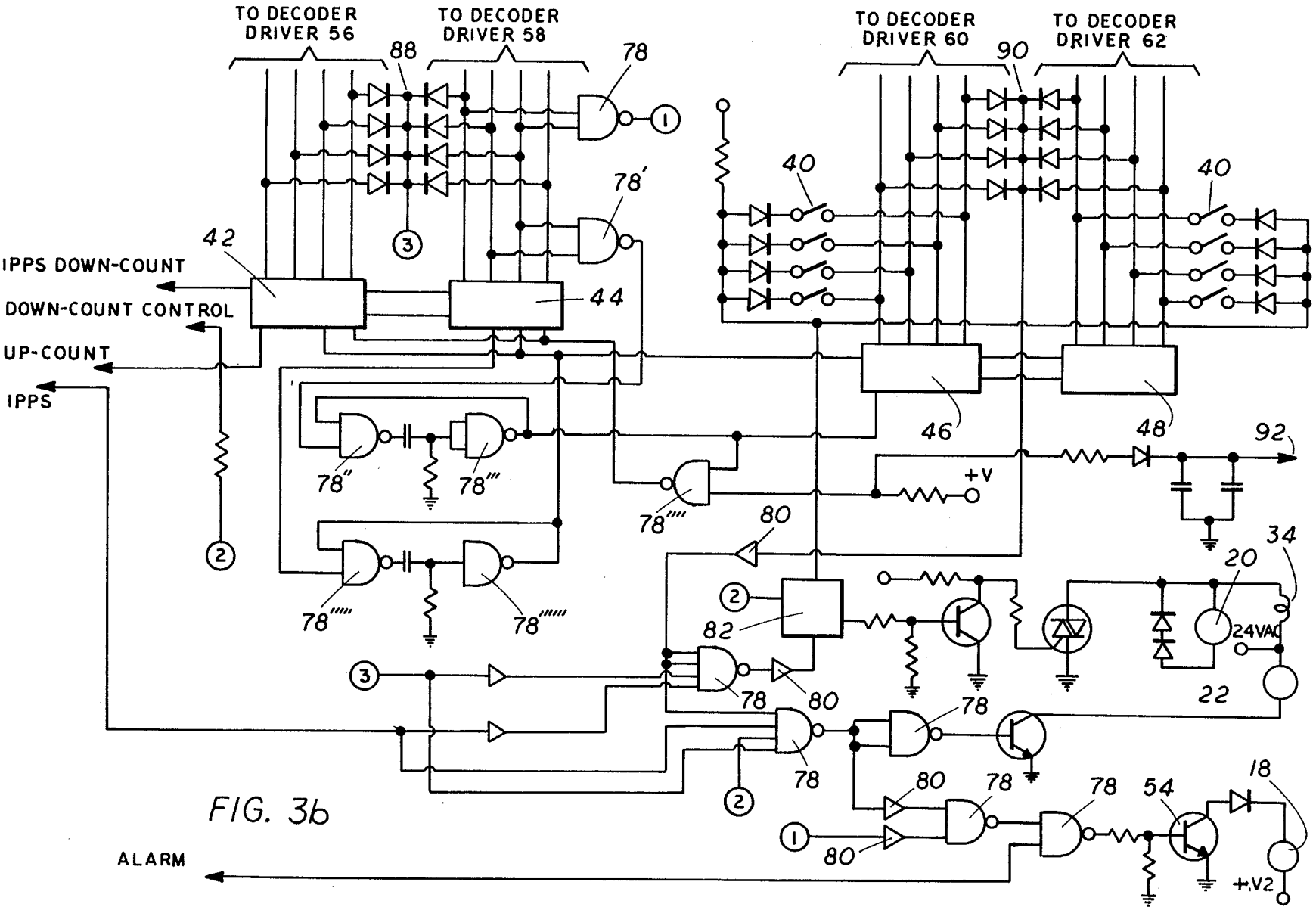
Figure 3C:
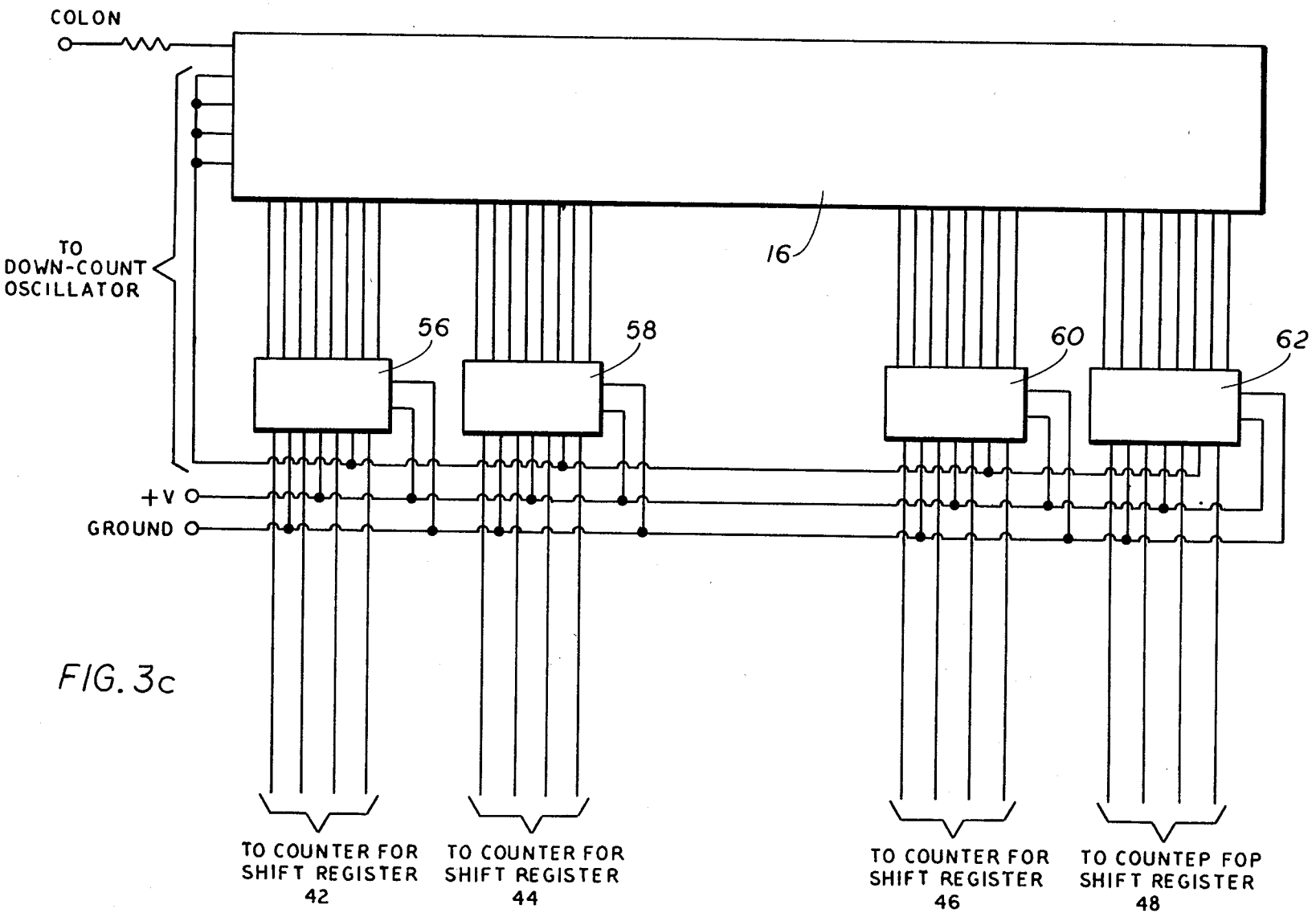

Referring to Circuit 3*b*, the count up and count down pulses received in the BCD Up/Down Counter 42, and transmitted to BCD Up/Down Counters 44,46 and 48 are transmitted to the LCD display readout 16 via BCD to 7 Segment Decoder/Drivers 56,58,60, and 62, shown in FIG. 3(*c*). The up count pulses, being generated at a higher pulse rate, are counted first in units of seconds, and when BCD Up/Down Counter 42 is filled, carrys over to tens of units of seconds, and when BCD Up/-Down Counter 44 is filled, carrys over via logic circuits to units of minutes, and when BCD Up/Down Counter 46 is filled, carrys over to tens of units of minutes, but for all practical purpose never completely fills BCD Up/Down Counter 48. The count down pulses which results in the diminishing of the number of pulses are counted so that when the pulses in the unit of seconds BCD Up/Down Counter 42 are depleted it borrows pulses from the tens of units of seconds BCD Up/Down Counter 44, which in turn borrows from the unit of minutes BCD Up/Down Counter 46 through logic circuits, which in turn borrows from the tens of units of minutes BCD Up/Down Counter 48 until it is emptied, and the process of borrowing then continues until BCD Up/Down Counter 46 is emptied, and the process then continues until BCD Up/Down Counter 44 is emptied, and then the process continues until BCD Up/Down Counter 42 is emptied, after which the system relay coil 34 is de-energized by a signal generated by the zero seconds detector 88, and the system shut down. It is noted that insertion of a coin anytime before the generation of the zero second signal will produce up count pulses, which because they are at a greater pulse rate than the pulse rate of the down count pulses, in effect are able to increase the period of time in the device. The dip switches 40 determining the time period before the system relay coil 34 is energized effectively determine the minimum time required to be purchased before the service or use is rented. At this time a signal is sent through System On Flip-Flop logic chip 82 and grounded emitter transistor 50 associated with said System On Flip-Flop logic chip. System On Flip-Flop logic chip 82 produces at this time a count down control signal which is sent to inverter 80 associated with the count down oscillator 30 and therefore allows the count down pulses to be sent to the BCD Up/Down Counters 42,44,46, & 48 for transmission to the LCD display readout to start the counting down of the elapsed time as stated in the foregoing paragraphs. At the same time the system relay coil 34 is energized, and the system on light 20 is lit.

As the counting down of the time being purchased continues to the point when the outputs of BCD Up/-Down Counters 46 & 48 are at zero that is to say both BCD Up/Down Counters are depleted a logic high will be generated and transmitted at this time via inverter 80 associated with the zero minute detector 90 to NAND gate 78 in the last minute light circuit, thereby producing no signal to the input of its associated inverter 80 therefore producing a signal to the input of the grounded emitter, switching transistor 50, energizing last minute lamp 22.

As the count down continues, providing no additional coin has been inserted in the coin receptacle, there will come a time when BCD Up/Down Counters 42 & 44 will become depleted At this time a logic high will be generated and transmitted through the inverter 80 associated with the zero second detector 88 to NAND gate 78. At NAND gate 78, there are four inputs; which are as follows: two logic lows from the zero minute detector 90; a logic low from inverter 80 associated with the signal from the System on Flip-Flop logic chip 82 and a logic low from inverter 80 associated with the zero second detector 88. This condition at the input of NAND gate 78 will produce an logic high to associated inverter 80 thereby producing a logic low at the input of System On Flip-Flop logic chip 82 turning its output off and therefore effecting the deenergizing of associated grounded emitter switching transistor 50 and de-energizing system relay coil 34 and the system on light 20. However, as stated in the foregoing paragraphs, if an additional coin is inserted in the coin receptacle at any time before the signal from the zero second detector 88 is sent out, the count up pulses generated as a result of this coin being at a greater rate than the one pulse per second down count will refill the BCD Up/-Down Counters and therefore increase the time elapsed with the additional time purchased.

The logic circuitry between the BCD Up/Down Counters 42,44 and BCD Up/Down Counters 46,48 employs NAND logic circuits in the carry and borrow circuits between the seconds and minutes BCD Up/-Down Counters 44 and 46. The NAND logic circuit in the carry circuit between BCD Up/Down Counters 44 and 46 comprises a NAND gate 78' at the output of the second and third lines corresponding to binary weights of 2 and 4, which produces an output whenever the output of BCD Up/Down Counter 44 reaches a count of six. NAND gates 78'' and 78''' are a configuration of cross coupled devices which produce a one shot momentary pulse to the up input of BCD Up/Down Counter 46 as well as a momentary pulse through NAND gate 78 to the reset inputs of BCD Up/Down Counters 42 and 44.

After the BCD Up/Down Counters have been loaded and the system relay coil 34 energized, as stated previously, the down input of BCD Up/Down Counter 42 receives a pulse every second. When BCD Up/-Down Counter 42 reaches a count of zero, it borrow output generates a pulse and delivers it into the down input of BCD Up/Down Counter; reloading BCD Up/-Down Countrer 42 at the same time. When BCD Up/-Down Counter 44 reaches a count of zero, its borrow output pulses the input of cross coupled NAND gates 78'''' and 78''''' to deliver a pulse into the down input of BCD Up/Down Counter 46; reloading the BCD Up/-Down Counters 42 and 44 at the same time by a load pulse resulting in the resetting of said counters to a predetermined count of 59 because each of the BCD Up/Down Counters 42 and 44 has been hard wired for said predetermined binary code.

As previously stated, counting down continues in this fashion of borrowing and preset load conditions until all BCD Up/Down Counters 42,44,46 and 48 reach the count of zero, at which time each of the outputs of the detectors 88 and 90 are in their logic lows resetting System On Flip-Flop logic chips 82 and resulting in the system relay coil being deenergized.

Referring to FIG. 3(*c*), the outputs from BCD Up/-Down Counters 42,44,46, & 48 are the inputs to BCD to 7 Segment Decoder/Drivers 58,60, & 62 respectively where the binary logic is decoder for utilization in the LCD display readout 16.

Although applicant's inventive apparatus has been described in only one apparatus and circuit embodiment, it is expected that applicant's invention will not be so limited or restricted but shall be limited only by the scope and breadth of the claims annexed hereto.

I claim:

1. A coin-operated, elapsed time apparatus comprising means for receiving coins at any time during its operating sequence, means for producing signals in response to said coins, means for providing counting down pulses to counters, switching means for providing predetermined quantities of counting up pulses to said in response to said signals, said counting up pulses being at pulse rates higher than the pulse rate of said counting down pulses, means for displaying the total of said counting up and counting down pulses, logic circuit means for employing said counting up and counting down pulses to energize a system and means for energizing ancillary apparatus further comprising warning lights and alarms during predetermined periods of time.

2. A coin operated, elapsed time apparatus as claimed in claim 1 wherein said counters comprise a plurality of up counters and down counters operating through cross coupled logic circuitry.

* * * * *